US011980280B2

(12) United States Patent
Ali

(10) Patent No.: US 11,980,280 B2
(45) Date of Patent: May 14, 2024

(54) WAIST MOUNTABLE ARTICLE CARRYING BELT ATTACHABLE ABOUT A JUG

(71) Applicant: Budee Systems LLC, Alexandria, VA (US)

(72) Inventor: Freddy N. Ali, Alexandria, VA (US)

(73) Assignee: BUDEE SYSTEMS LLC

( * ) Notice: Subject to any disclaimer, the term of this patent is extended or adjusted under 35 U.S.C. 154(b) by 85 days.

(21) Appl. No.: 17/690,507

(22) Filed: Mar. 9, 2022

(65) Prior Publication Data

US 2023/0284769 A1 Sep. 14, 2023

(51) Int. Cl.
*A45F 3/14* (2006.01)
*B65D 23/12* (2006.01)
*A45F 3/00* (2006.01)

(52) U.S. Cl.
CPC ..... *A45F 3/14* (2013.01); *B65D 23/12* (2013.01); *A45F 2003/003* (2013.01); *A45F 2003/144* (2013.01)

(58) Field of Classification Search
CPC ..... A45F 3/14; B65D 23/12
USPC ..... 224/584, 148.4, 579, 580
See application file for complete search history.

(56) References Cited

U.S. PATENT DOCUMENTS 413,526 A * 10/1889 Light ..... A47L 13/58 15/264
1,482,130 A * 1/1924 Griest ..... A47L 3/04 182/4
4,765,472 A * 8/1988 Dent ..... A47J 47/18 206/373
5,027,973 A * 7/1991 Drogos ..... B65D 25/325 220/773
D376,454 S * 12/1996 Fierek ..... D32/54
5,649,623 A * 7/1997 Kornblatt ..... B25H 3/02 248/210
5,833,095 A * 11/1998 Russell ..... A45F 5/02 224/684
5,931,363 A * 8/1999 Ammons, Jr. ..... G03C 3/00 224/679
6,126,035 A * 10/2000 Schaper ..... B65D 25/2867 206/505

(Continued)

OTHER PUBLICATIONS

Milwaukee Tool Company—Bucket Organizer Wrap (Pictures Attached).

(Continued)

*Primary Examiner* — Nathan J Newhouse
*Assistant Examiner* — Lester L Vanterpool
(74) *Attorney, Agent, or Firm* — H. Jay Spiegel

(57) ABSTRACT

A waist mountable article carrying belt is also attachable about a jug. Two separate components combine together to create the belt, a base which includes a variety of compartments, slots, bands, and other devices designed to facilitate the carrying of various items, and a separate band with adjustable features allowing adjustment of its length. The band also includes fasteners at each end that are complementary to the fasteners on the ends of the base so that the band may be coupled to the base. The preferred jug includes an integrally molded handle and includes an opening between the handle and jug body that allows the band to be passed through the opening when fastening the base and band to the periphery of the jug.

18 Claims, 9 Drawing Sheets

(56) References Cited

U.S. PATENT DOCUMENTS 6,213,365 B1 * 4/2001 Stocke ..... A41D 13/0012 224/684
6,223,411 B1 * 5/2001 Willey ..... B65D 23/12 29/428
D446,617 S * 8/2001 Urbanski ..... D32/53
6,276,579 B1 * 8/2001 DeLoach ..... A45F 3/16 383/110
6,702,168 B2 * 3/2004 Panosian ..... A45C 5/00 224/684
6,991,829 B2 * 1/2006 Bergman ..... B65D 25/2817 220/769
7,073,205 B2 * 7/2006 Finn ..... A41D 19/0037 2/160
7,172,533 B2 * 2/2007 Hobbs ..... A47G 19/22 482/93
7,341,149 B2 * 3/2008 DeAntoni ..... B25H 3/00 224/904
D581,658 S * 12/2008 Leslie ..... D3/229
7,909,202 B1 * 3/2011 Gordon ..... B65D 23/106 220/742
8,418,901 B2 * 4/2013 Stimmell ..... F42B 39/08 224/648
9,845,171 B2 * 12/2017 Conway ..... B65D 1/0284
11,172,753 B2 * 11/2021 Picking ..... A45F 3/14
2003/0131398 A1 * 7/2003 Haines ..... A45F 5/021 2/312
2004/0195252 A1 * 10/2004 von Holdt, Sr. ..... B65D 1/46 220/659
2006/0081748 A1 * 4/2006 Sherman ..... A47L 13/51 248/309.1
2006/0278676 A1 * 12/2006 Lyle ..... F41C 33/041 224/904
2007/0065050 A1 * 3/2007 McMillen ..... A45F 5/00 383/22
2008/0006668 A1 * 1/2008 Nowacki ..... A45F 5/021 224/625
2010/0314351 A1 * 12/2010 Hoefling ..... B65D 23/08 215/386
2014/0203057 A1 7/2014 Goryl
2015/0265083 A1 * 9/2015 Myers ..... A45F 5/10 220/737
2016/0101646 A1 * 4/2016 Kiceniuk ..... B44D 3/121 206/229
2017/0156478 A1 6/2017 Steele
2018/0295972 A1 10/2018 Do
2020/0069036 A1 3/2020 Neibarger
2021/0085062 A1 3/2021 Steele
2021/0130040 A1 * 5/2021 Sanders ..... D04B 21/20
2021/0229865 A1 * 7/2021 Wang ..... B65D 23/0871

OTHER PUBLICATIONS

Airflow Trail Pack; Smartview Waist Pack; Microstretch-Flash Rechargeable Waist Pack; and various other airflow products (Pictures Attached).
REI Co-Op—Trail 5 Waist Pack (Pictures Attached).

* cited by examiner

WAIST MOUNTABLE ARTICLE CARRYING BELT ATTACHABLE ABOUT A JUG

BACKGROUND OF THE INVENTION

The present invention relates to a waist mountable article carrying belt attachable about a jug. The present invention provides flexibility and versatility, allowing the user to carry various items about their waist while also permitting the same device to be mounted about a drinking jug to relieve the user of having to carry the various items contained within compartments on the belt while at rest or engaging in other activities.

The following prior art is known to Applicant:

U.S. Pat. No. 4,765,472 to Dent discloses a bucket attachment tool holder. The tool holder has a wide vertical dimension and a series of pockets designed to hold tools and is sized to be mounted about the periphery of a bucket. This device is not susceptible to being worn about the waist of a user due to its large vertical dimension.

A similar commercialized product is sold by the Milwaukee Tool Company and is described by them as the Bucket Organizer Wrap. The present invention distinguishes from both the Dent patent and the Milwaukee Bucket Organizer Wrap as allowing the versatility of being worn on the waist of the user and also being attached about the periphery of a drinking jug.

U.S. Published Application No. US 2014/0203057 A1 to Goryl discloses a front backpack in which a large container is supported in front of the user by a complex device that includes straps over the shoulders as well as about the chest and waist. The present invention distinguishes from Goryl as contemplating a device solely supported about the waist of the user while also having the versatility to be mounted about a drinking jug.

U.S. Published Application No. US 2017/0156478 A1 to Steele discloses a hiking survival pack including supports extending over the shoulders of the wearer and about the chest and including a drinking container attached thereto. The present invention differs from the teachings of Steele as contemplating a waist borne article carrying belt.

U.S. Published Application No. US 2018/0295972 A1 to Do discloses a wearable carrying accessory that consists of a pouch for holding items and is formed as a tube of stretchable material and formed as a single circle to mount about the periphery of the wearer. The present invention distinguishes from the teachings of Do as contemplating a waist borne article carrying belt with a plurality of visible compartments and also being able to be mounted about a drinking jug.

U.S. Published Application No. US 2020/0069036 A1 to Neibarger discloses a carrier system for use with a body armor garment that is designed to distribute shoulder loads produced by equipment carried or worn by military or law enforcement personnel. The device is intended to distribute the load from the wearer's shoulders to the wearer's hips. In the present invention, there is no ability to distribute the load to the shoulders of the wearer and the present invention solely contemplates a device worn about the waist of the wearer when worn by the user.

U.S. Published Application No. US 2021/0085062 A1 to Steele is similar to Steele '478 discussed supra as comprising a device supported about the shoulders of the wearer. The present invention distinguishes from Steele '062 as contemplating solely waist support.

Applicant is also aware of several commercialized products that include waist support but differ from the teachings of the present invention. These include the Airflow Trail Pack which is supported about the waist of the wearer, the Smartview Waist Pack which is design to horizontally support a smartphone, the Microstretch-Flash Rechargeable Waist Pack which is designed to provide a flashing light for safety purposes, and various other airflow products. None of these products teaches or suggests the core concepts of the present invention, namely, a waist mountable article carrying belt that is also attachable about a drinking jug.

REI Co-Op sells a waist pack known as the TRAIL 5 Waist Pack which is worn about the waist of the wearer and includes a single large compartment to store numerous items as well as a few pockets to either side of the large container. This device fails to teach the core concepts of the present invention including not only being supportable about the waist of the wearer but also attachable about a jug.

SUMMARY OF THE INVENTION

The present invention relates to a waist mountable article carrying belt attachable about a jug. The present invention includes the following interrelated objects, aspects, and features:

(1) In a first aspect, the present invention contemplates a waist mountable article carrying belt. In the preferred embodiment, two separate components combine together to create the belt.

(2) A first component comprises a base which includes a variety of compartments, slots, bands, and other devices designed to facilitate the carrying of various items as will be described in greater detail below. At each end of the base, a fastener is provided.

(3) The components of the belt also include a separate band with adjustable features allowing adjustment of its length. The band also includes fasteners at each end that are complementary to the fasteners on the ends of the base so that the band may be coupled to the base. Examples of fasteners that may be used in accordance with the teachings of the present invention include various clips, buttons, snaps, hook and pile fastening means known by the trademark VELCRO®, and others.

(4) The base is provided with a rear surface that faces the wearer that also allows for better grippability when the base and band are fastened about a drinking jug.

(5) Among the attachment features on the base are credit card slots, zippered compartments, elastic material loops, a receptacle for a smartphone that includes a transparent face to allow viewing the smartphone through the transparent face, and compartments including those with a closure flap as well as a plurality of grommets.

(6) The band includes, in the preferred embodiment, two parts that are interconnected together using clips. One of the bands may have an end extending through a slot in a clip that includes hook and pile fastening means allowing the adjustment of the total length of the band to allow the band and the base, together, to snugly fit about the waist of the wearer, and also with sufficient adjustability to allow attachment about a jug. While various attachment devices may be employed in accordance with the teachings of the present invention, one preferred attachment means is what is known as a side release buckle that includes one-half with two flexible tangs that fit within a slot in the other half, and the other half has openings that allow one to squeeze the tangs together to release the buckle.

(7) In accordance with the teachings of the present invention, the preferred jug that forms an integral part of the present invention is one that includes an integrally molded handle that includes an opening that allows the band to be passed through the opening when fastening the base and band to the periphery of the jug.

(8) In the preferred embodiment of the jug, it has a generally cylindrical periphery with the opening mentioned above extending only part way from the top of the jug to the bottom. This allows the base and band to be situated on the jug somewhere in the middle between the top and the bottom of the jug when the base and band are attached thereto.

(9) In attaching the base and band about the jug, the buckles or clips fastening the base to the band are disconnected or at least one is, and the base is wrapped partially around the periphery of the jug whereupon the band is inserted through the opening in the jug behind the handle thereof, and the buckles or clips are fastened together and then the hook and pile fastening means adjustment system on the band is used to tighten the base and band about the jug.

(10) The rear face of the base has a layer of material such as rubber which helps to add friction to the interconnection between the base and band on the one hand, and the jug on the other hand to hold the base in place without slippage.

(11) The jug may have any desired capacity but should be sized sufficiently large enough that the base does not wrap all the way around without inclusion of the band. Otherwise, the base and band could not be fastened about the jug.

As such, it is a first object of the present invention to provide a waist mountable article carrying belt attachable about a jug.

It is a further object of the present invention to provide such a device in which a base is provided with numerous compartments and other attachment means allowing the removable reception of numerous objects such as paper, writing instruments, a smartphone, and other objects.

It is a still further object of the present invention to provide such a device in which a band is separable from a base to allow the device to be attached about the waist of the wearer or about the periphery of a jug designed for that purpose.

It is a yet further object of the present invention to provide the band with adjustability to allow the total length of the base and band to be adjustable for waists of differing sizes and jugs of differing diameters and circumferences.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
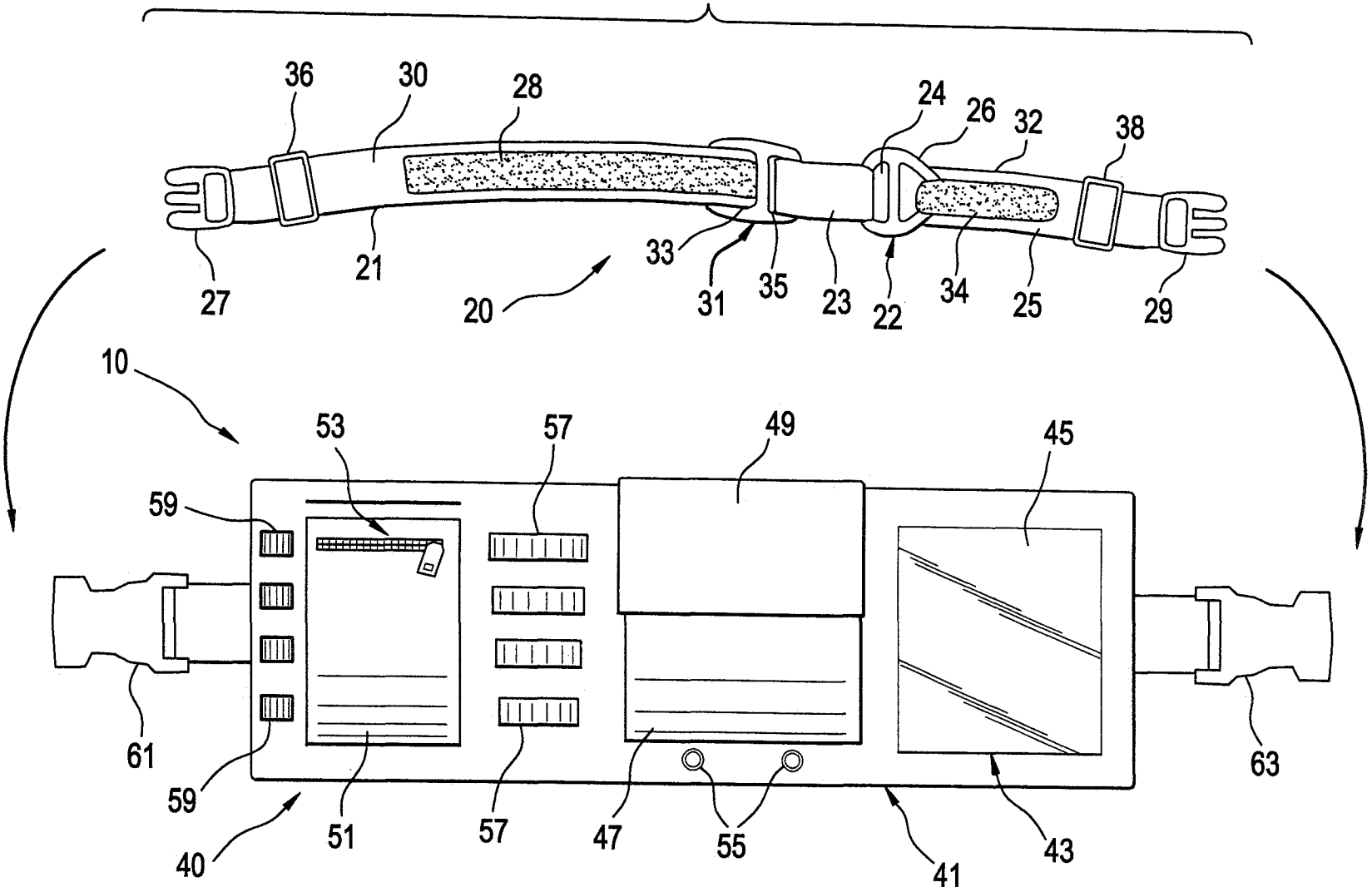
FIG. 1 shows a view of the base and band of the present invention.

With reference, first, to FIG. 1, the present invention is generally designated by the reference numeral 10 and is seen to include a band 20 and a base 40. The band 20 includes straps 21, 23, and 25. Buckle halves 27 and 29 are at the extreme ends of the band 20. A clip 31 with slots 33 and 35 allows interconnection of the strap 21 and the strap 23. A further clip 22 includes openings 24 and 26 that allow interconnection of the straps 23 and 25. As seen in FIG. 1, the strap 21 includes a portion 28 that loops through the opening 33 in the clip 31 and folds back upon itself. The surface 30 of the strap 21 is covered with one-half of a hook and pile fastening means best known by the registered trademark VELCRO®. The other side of the portion 28 holds the other half of the hook and pile fastening means so that the portion 28 can be pulled through the opening 33 and fastened to enable adjustment of the length of the strap 21.

Similarly, the strap 25 has its surface 32 covered with one-half of a hook and pile fastening means while the portion 34 of the strap 25 has an underside covered with the other half of the hook and pile fastening means so that the portion 34 of the strap 25 can be pulled through the opening 26 and fastened to allow adjustment of the effective length of the strap 25.

Additional adjustment means 36 and 38 allow further length adjustment.

The base 40 includes a generally rectangular body 41 with a plurality of article holding devices. They include a plurality of compartments attached thereto. Thus, the compartment 43 includes a transparent front portion 45 so that it can receive a smartphone with the front of the smartphone visible through the surface 45. Another compartment 47 has a flap 49 that may be moved to the position shown in FIG. 1 to cover a top opening of the compartment (not shown) within which to store various objects.

A further compartment 51 includes an opening that is opened and closed by the provision of a zipper 53.

Other article holding devices include the following. Grommets 55 are provided to allow attachment of a tether made of string, bungee cord or any suitable material to allow attachment of another object which could include a drink container. Loops 57 are provided between the compartments 51 and 47 to allow attachment of other objects. The loops 57 may be made of an elastic material allowing them to be stretched to accommodate to objects of differing sizes. The loops 57 may also be used to attach other objects such as key rings.

Additionally, a series of aligned loops 59 are provided which allow receipt of, for example, a pen or pencil, or other elongated thin object.

At either end of the base 40, a half of a fastening means is provided. These are designated by the reference numerals 61 and 63. These are first and second fasteners. As should be understood from FIG. 1, these fastener halves are respectively coupled to the fastener halves 27 and 29 also described as third and fourth fasteners employed to couple the band 20 to the base 1.

Figure 2:
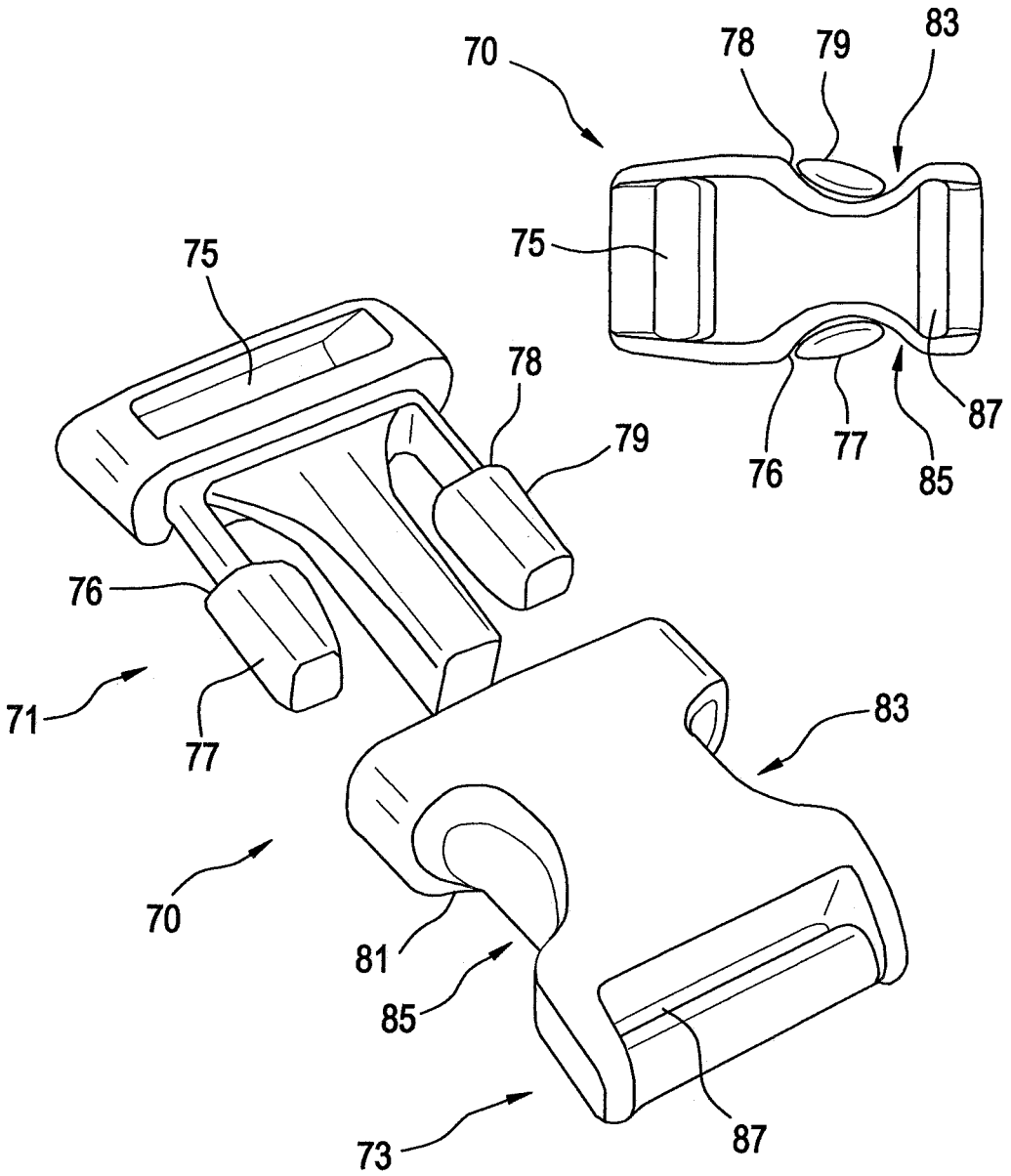
FIG. 2 shows an enlarged view of an example of a side release buckle usable in accordance with the teachings of the present invention.

With reference to FIG. 2, a side release buckle is generally designated by the reference numeral 70 and may comprise the fasteners designated by the reference numerals 27, 29, 61 and 63 in FIG. 1. The buckle 70 includes complementary halves comprising a first half 71 and a second half 73. The first half 71 includes an opening 75 allowing attachment of a strap that can be extended therethrough. It also includes two flexible tangs 77 and 79 which are received within a slot 81 in the fastener half 73. As should be understood, the tangs 77 and 79 are squeezed toward one another, whereupon the half 71 is pushed into the half 73 until the shoulders 76 and 78 of the tangs 77 and 79, respectively, pass through the slot 81 and allow the tangs 77 and 79 to spring away from each other in the recesses 83 and 85. The half 73 also includes an opening 87 allowing attachment of a strap extended therethrough. When the halves 71 and 73 are fastened together and it is desired to release them, typically, the thumb and forefinger of the user squeeze the tangs 77 and 79 together until the shoulders 76 and 78 are inward of the recess 81, whereupon the halves 71 and 73 can be pulled apart.

Figure 3:
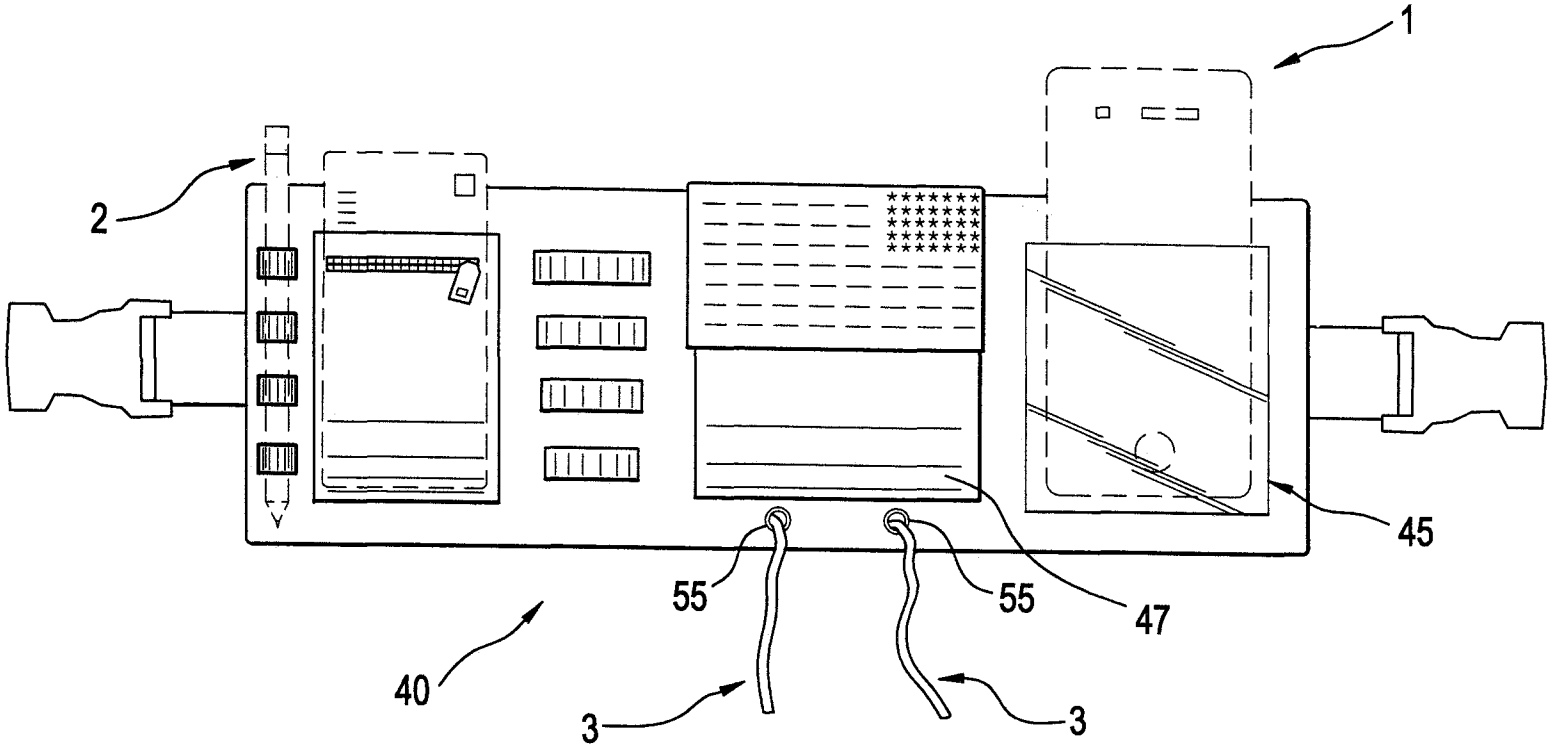
FIG. 3 shows a front view of the base of the present invention with various objects secured thereon as an example.

With reference to FIG. 3, the base 40 is seen with several objects loaded therein including a smartphone 1 loaded into the compartment 45, a pencil 2 received within the loops 59, strings 3 attached to the grommets 55, and, if desired, the compartment 47 holding a pack of gum (not shown).

Figure 4:
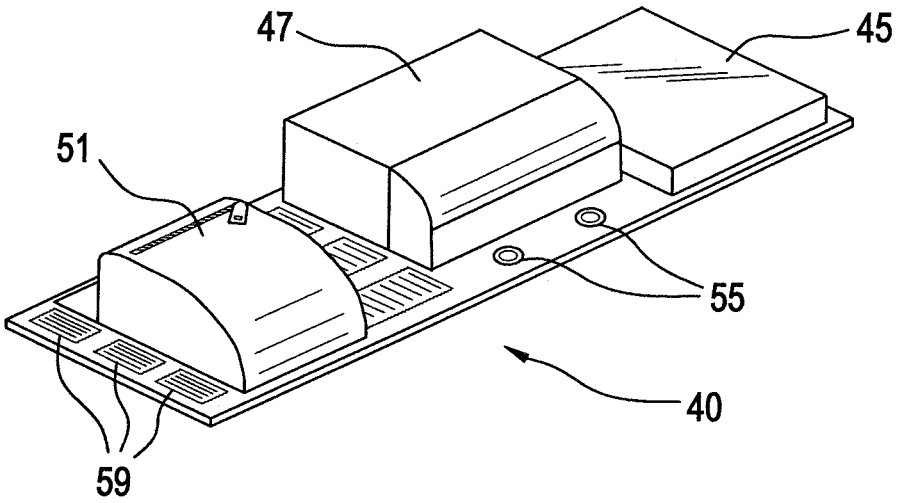
FIG. 4 shows a perspective view of the base of the present invention showing the possible depth of various compartments.
Figure 5:
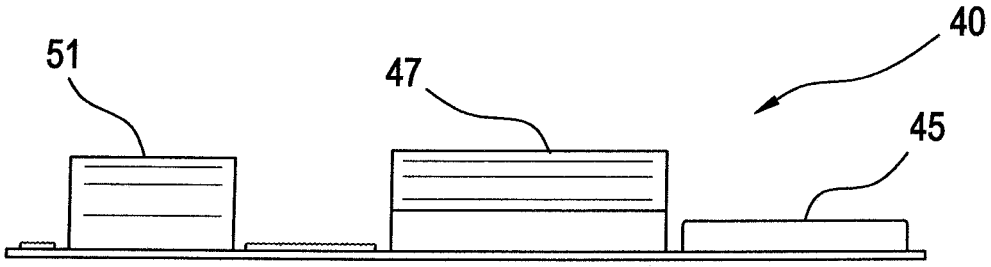
FIG. 5 shows a top view of the structure shown in FIG. 4.

With reference to FIGS. 4 and 5, different views of the base 40 are shown which illustrate the depth of the compartments 45, 47 and 51. The grommets 55 and the loops 59 are also clearly shown.

Figure 6:
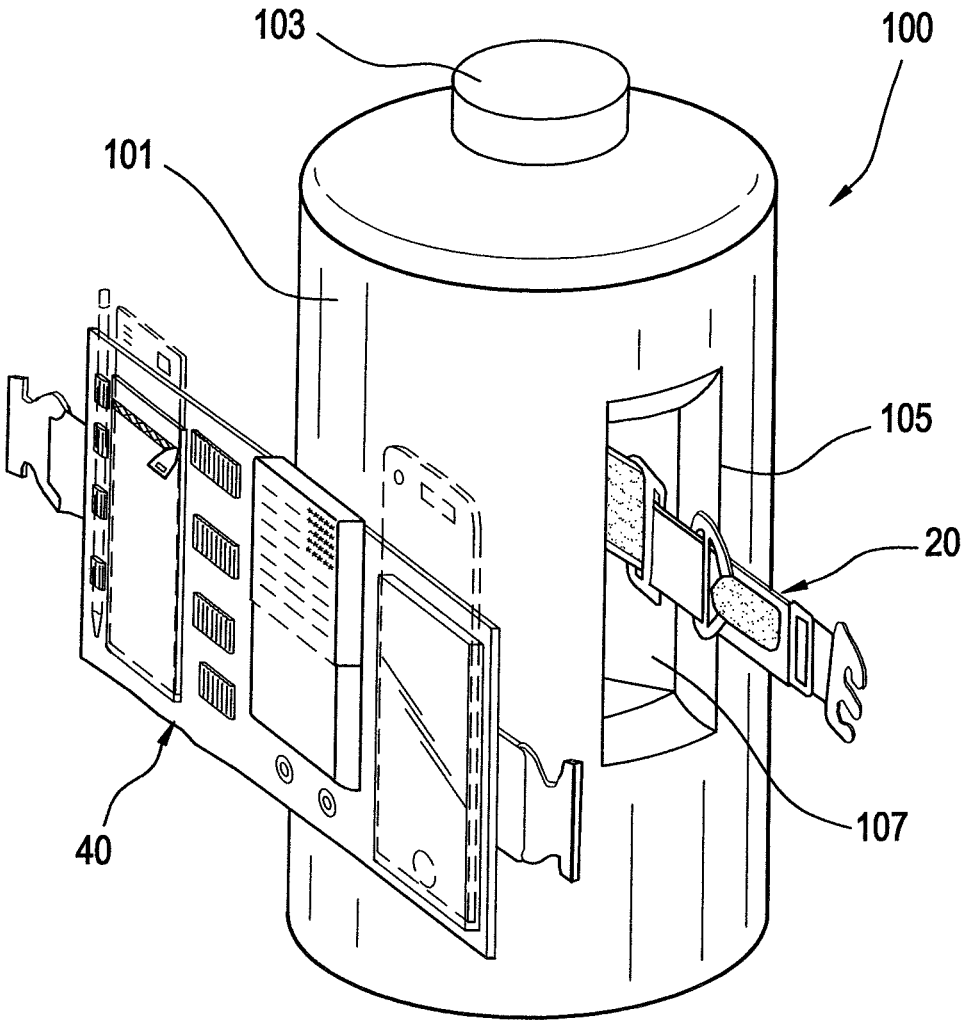
FIG. 6 shows a perspective view of the base and band during the process of securing them on a jug.
Figure 7:
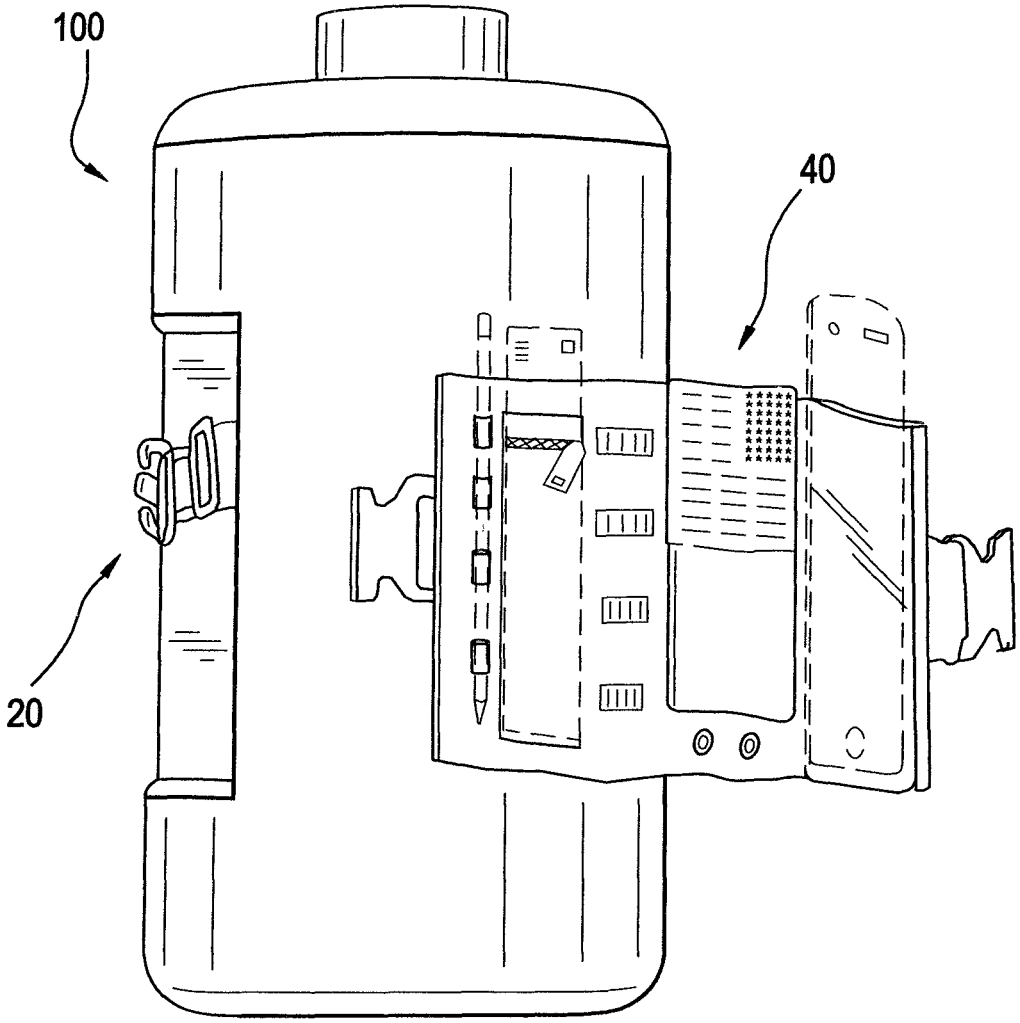
FIG. 7 shows a view of the base and band being secured about a jug from a different perspective than that of FIG. 6.

With reference to FIGS. 6 and 7, the preferred design for the container or jug is generally designated by the reference numeral 100 and is seen to include a generally cylindrical body 101 with a circumference, a cap 103 comprising a closure for an opening (not shown) allowing access to the interior of the jug 100, a handle 105 integrally formed with the jug 100, and an opening 107 between the handle 105 and the body 101 of the jug. The interior of the jug is intended to receive and store a liquid, preferably, for drinking.

The strap 20 of the band 20 is seen extended through the opening 107 between the handle 105 and the body 101 of the jug 100. The base 40 is seen suspended in front of the jug 100 in the view of FIG. 6. FIG. 7 shows a view from the other side of the jug 100 showing an end of the band 20 and the base 40 suspended as shown for ease of understanding.

Figure 8:
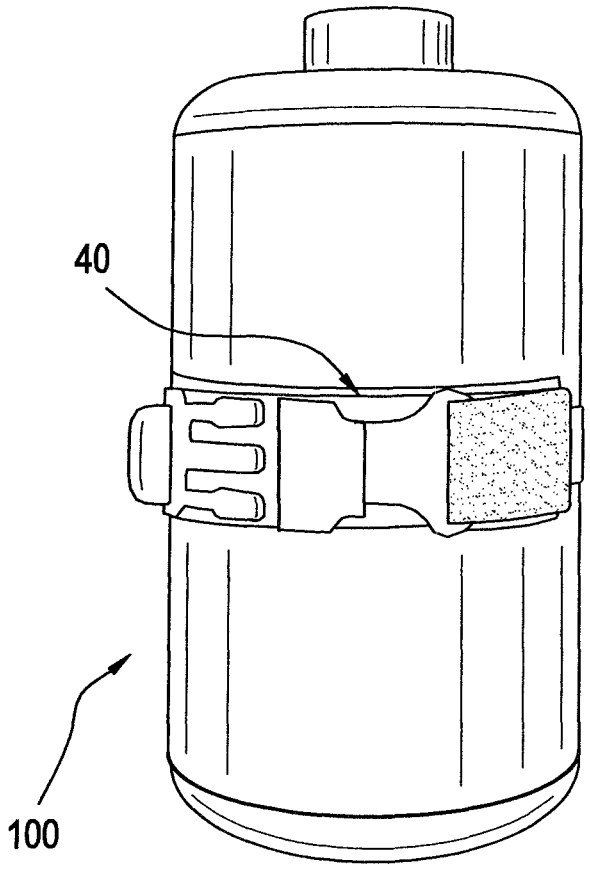
FIG. 8 shows a side view of a jug with the inventive base and band secured thereabout.
Figure 9:
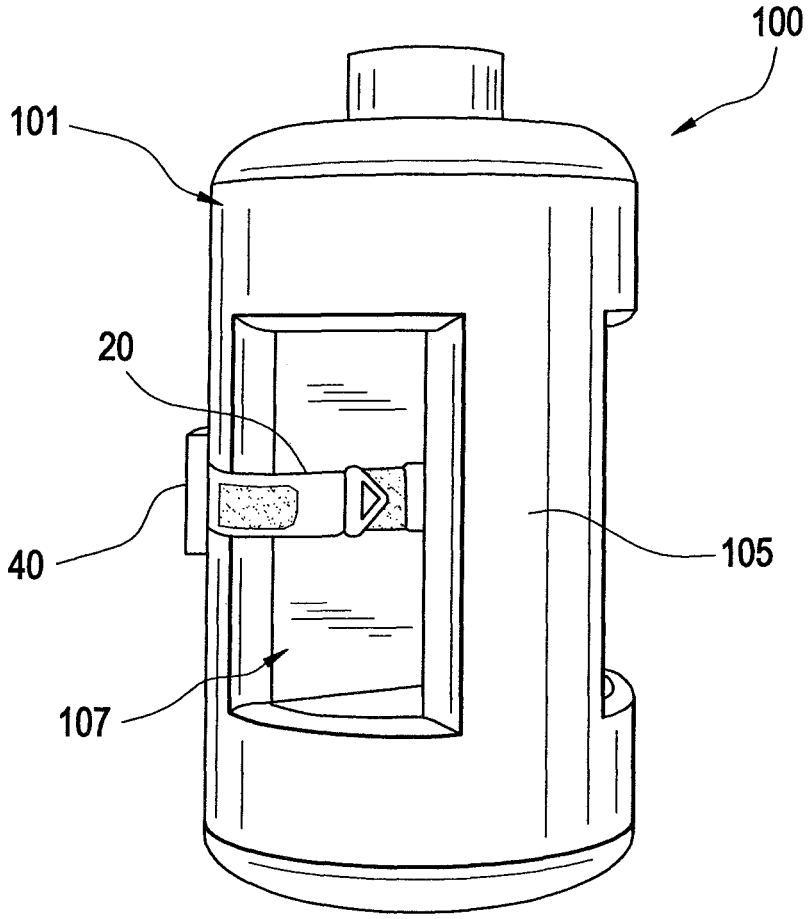
FIG. 9 shows a view rotated from the view of FIG. 8 showing the band extending through the opening between the handle and body of the jug.

FIG. 8 shows the jug 100 with the base 40 and strap 20 (not shown in FIG. 8) attached about the circumference of the jug 100. FIG. 9 shows an end of the band 20 extending through the opening 107 between the handle 105 and the body 101 of the jug 100.

Figure 10:
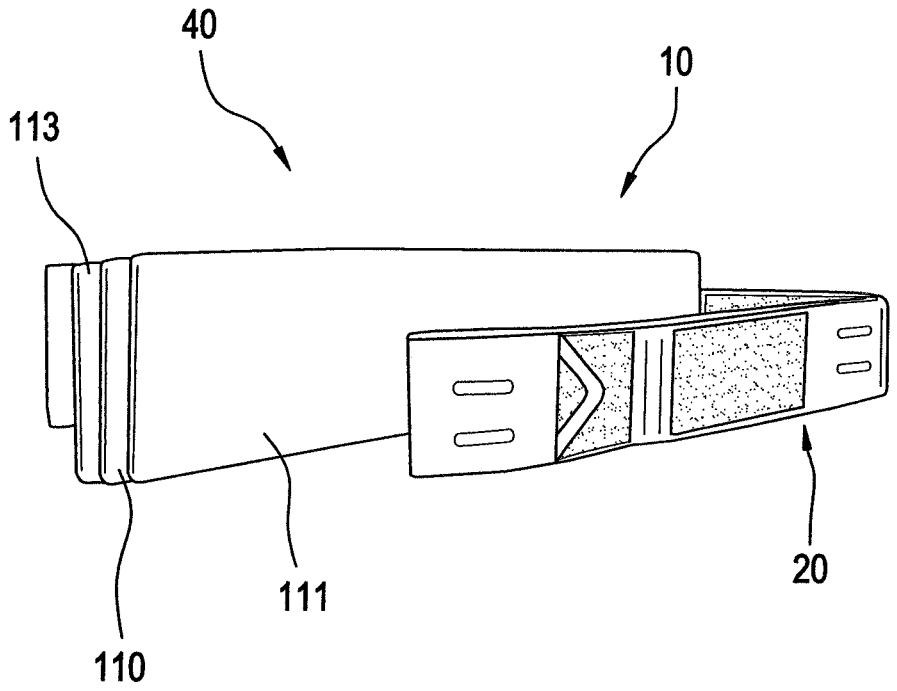
FIG. 10 shows a perspective view partially in cross-section showing the materials of the base and band.

FIG. 10 shows a perspective view of the device 10, partially in cross-section, including the band 20 and the base 40. As shown in FIG. 10, the base 40 has plural layers of thickness including a layer 110 made of a gripping material such as, for example, rubber or synthetic rubber with a surface 111 which faces the jug 100 when the device 10 is mounted therearound. This rubber or synthetic rubber surface 111 assists in gripping the jug 100 to prevent the device 10 from slipping up or down when the band 20 is tightened in the manner explained supra to affix the device 10 to the jug 100. Another layer 113 of the base 40 can be comprised of a textile material such as cotton, polyester or the like, and provides the underpinning for the compartments best seen with reference to FIGS. 1 and 3.

In the preferred manner of use of the present invention, the various compartments and loops and grommets are employed to place whatever desired objects can be placed therewithin or attached thereto. The device 10 may then be attached about the waist of the user in the manner explained supra by attaching the band to the base using fasteners such as that which is illustrated in FIG. 2 which are clipped together with the straps 28 and 34 being suitably adjusted to tightly affix the device 10 in place. When it is desired to remove the device 10 from the wearer, it may be affixed about the circumference of a jug 100, as explained above, by attaching the band to the base and then activating the clips, such as the clip 70 shown in FIG. 2, in the manner described supra to attach the device 10 about the jug 100. The strap portions 28 and 34 may be adjusted to tighten the device 10 about the jug 100.

Any desired materials can be employed for the different components of the inventive device 10. For example, the grommets 55 can be made of metal or plastic, the clear front of the compartment 43 can be made of any desired transparent material such as plastic and the like, the fasteners 70 as well as the clips 22 and 31 can be made of any desired material, and any desired elastic material can be used for the loops 59 as well as those designated by the reference numeral 57.

Accordingly, an invention has been disclosed in terms of preferred embodiments thereof, which fulfill each and every one of the objects of the invention as set forth hereinabove, and provide a new and useful waist mountable article carrying belt attachable about a jug of great novelty and utility.

Of course, various changes, modifications, and alterations in the teachings of the present invention may be contemplated by those skilled in the art without departing from the intended spirit and scope thereof.

As such, it is intended that the present invention only be limited by the terms of the appended claims.

The invention claimed is:

1. An article carrier configured to fit about a waist of a wearer as well as a container, comprising:

a) a base with first and second ends;

b) between said first and second ends, a plurality of article holding devices, including at least one compartment with a transparent front and at least one loop;

c) at said first end, a first fastener is provided;

d) at said second end, a second fastener is provided;

e) a band having an adjustable length and first and second ends;

f) said band having a third fastener at said first end and a fourth fastener at said second end;

g) said first and third fasteners being connectable together to releasably attach said first end of said base to said first end of said band;

h) said second and fourth fasteners being connectable together to releasably attach said second end of said base to said second end of said band;

i) said length of said band may be adjusted to secure said base and band, as interconnected, around a waist of a wearer; and j) a container having a side wall having a circumference and an opening accessed at said side wall, said base and band, when attached together, being securable about said circumference to support said base and band on said container, said band being insertable through said opening with said band and base placed in surrounding relation to said side wall of said container to fasten said base and band, as interconnected, about said side wall of said container.

2. The article carrier of claim 1, wherein said first and third fasteners comprise complementary halves of a side release buckle.

3. The article carrier of claim 2, wherein said second and fourth fasteners comprise complementary halves of a side release buckle.

4. The article carrier of claim 1, wherein said at least one compartment is sized to receive a smartphone.

5. The article carrier of claim 1, wherein said at least one compartment includes a closure flap.

6. The article carrier of claim 1, wherein said at least one compartment has an opening closeable with a zipper.

7. The article carrier of claim 1, wherein said band is made of a plurality of straps interconnected together, at least one of said straps having an adjustable length.

8. The article carrier of claim 7, wherein two of said straps have an adjustable length.

9. The article carrier of claim 1, wherein said at least one loop comprises a plurality of axially aligned loops.

10. The article carrier of claim 9, wherein said loops are sized to releasably receive an elongated thin object.

11. The article carrier of claim 10, wherein said elongated thin object is chosen from the group consisting of a pen and a pencil.

12. The article carrier of claim 1, wherein said base has at least one grommet with an opening configured to receive an elongated tether.

13. The article carrier of claim 1, wherein said opening comprises a first opening and said container comprises a jug with an interior volume for receiving a liquid and a closure closing a second opening allowing access to said interior.

14. The article carrier of claim 13, wherein said jug has a generally cylindrical body with an integrally molded handle and said first opening located between said body and said handle, said closure comprising a cap.

15. An article carrier configured to fit about a waist of a wearer as well as a drinking container, comprising:

a) a base with first and second ends;

b) between said first and second ends, a plurality of article holding devices, including a plurality of compartments and at least one loop, at least one of said compartments having a transparent front;

c) at said first end, a first fastener is provided;

d) at said second end, a second fastener is provided;

e) a band having an adjustable length and first and second ends;

f) said band having a third fastener at said first end and a fourth fastener at said second end;

g) said first and third fasteners comprising halves of a side release buckle and being connectable together to releasably attach said first end of said base to said first end of said band;

h) said second and fourth fasteners being connectable together to releasably attach said second end of said base to said second end of said band;

i) with fasteners interconnected as recited in paragraphs g) and h), said length of said band may be adjusted to secure said base and band around a waist of a wearer; and j) a drinking container having a side wall having a generally cylindrical circumference and an opening accessed at said circumference, said base and band, when attached together, being securable about said circumference to support said base and band on said container, said band being insertable through said opening with said band and base placed in surrounding relation to said side wall of said container to fasten said base and band, as interconnected, about said side wall of said container.

16. The article carrier of claim 15, wherein at least one of said compartments is sized to receive a smartphone, and at least one further compartment includes a closure flap.

17. The article carrier of claim 15, wherein said band is made of a plurality of straps interconnected together, at least two of said straps having an adjustable length.

18. The article carrier of claim 15, wherein said opening comprises a first opening, and said drinking container comprises a jug with an interior volume for receiving a liquid and a cap closing a second opening allowing access to said interior, said jug having an integrally molded handle and said first opening being located between said body and said handle.

* * * * *